US006055684A

United States Patent [19]

Azuma

[11] Patent Number: 6,055,684

[45] Date of Patent: May 2, 2000

[54] SAUNA APPARATUS

[76] Inventor: Yoshihiko Azuma, 6-28, Nakajima-cho, Nishinomiya-shi, Hyogo, Japan

[21] Appl. No.: 09/255,648

[22] Filed: Feb. 22, 1999

Related U.S. Application Data

[62] Division of application No. 08/964,166, Nov. 4, 1997.

[30] Foreign Application Priority Data

Apr. 10, 1997 [JP] Japan ..... 9-2706
May 30, 1997 [JP] Japan ..... 9-141394

[51] Int. Cl.[7] ..... A61H 33/06
[52] U.S. Cl. ..... 4/526; 4/531
[58] Field of Search ..... 4/526–532, 524; 607/81, 83, 84

[56] References Cited

U.S. PATENT DOCUMENTS

| | | | |
|---|---|---|---|
| 247,670 | 9/1881 | Markham | 4/532 |
| 569,808 | 10/1896 | Wyckoff | 4/527 |
| 1,488,404 | 3/1924 | Monford | 4/528 |
| 2,346,827 | 4/1944 | Cotter | 4/527 |
| 2,539,710 | 1/1951 | Sziklay | 4/527 |

*Primary Examiner*—Charles R. Eloshway
*Attorney, Agent, or Firm*—Schweitzer Cornman Gross & Bondell LLP

[57] ABSTRACT

A sauna having (i) a sauna chamber of a size to accommodate a person therein, and two side walls, a front wall, a rear wall, and a ceiling, (ii) a ventilation opening in a wall of the sauna chamber, the opening being at a height corresponding to the location of the head of a person within the chamber and having a size sufficient to provide a low temperature sauna due to the communication of air between the interior and the exterior of the sauna chamber, (iii) a lid for selectively opening and closing the ventilation opening, and (iv) a detachable engaging mechanism for maintaining the lid in a preselected position relative to the opening, wherein the ventilation opening is substantially circular and has a diameter and an inner peripheral surface on the wall, and the detachable engaging mechanism has an annular engaging groove formed on the inner peripheral surface, a slider, an engaging claw on the slider, the slider being diametrically movable on the lid, a spring biasing the engaging claw into engagement with the engaging groove, and a knob for manually operating the slider for releasing the engagement against the bias of the spring.

1 Claim, 6 Drawing Sheets

SAUNA APPARATUS

This is a divisional application of Ser. No. 08/964,166, filed on Nov. 4, 1997.

FIELD OF THE INVENTION

The present invention relates to improvements in sauna apparatus. More specifically, the invention relates to a sauna apparatus for household use.

BACKGROUND OF THE INVENTION

A household sauna is generally provided with a sauna chamber of a size to permit usually one person to enter, the chamber having side walls, a front wall, a back wall and an upper ceiling or cover, and electric heaters such as on the front wall and the back wall to heat the interior of the chamber. Sauna apparatus of this type elevates the interior temperature of the sauna to 60° C. or higher, such as to promote perspiration of the user of the sauna. However, for elderly or sick persons the physical load imposed by such higher sauna temperature can become sufficiently great to present a danger. Sauna apparatus was proposed for such situations, in which the temperature in the sauna chamber can be set a lower temperature, e.g. about 40° C. which will not cause perspiration, but will promote blood circulation of the user by the so-called thermal effect at a lower temperature, such as in a warm bath.

When the sauna is to be used at normal high temperatures suitable to produce perspiration with conventional control system, even if the temperature is set only for warm bath type use for example at 40° C., the temperature in the sauna chamber can significantly fluctuate about the set temperature making it difficult for comfortable use. Therefore, a special control unit has to be employed which will make the cost of the sauna apparatus high.

SUMMARY OF THE INVENTION

It is an object of the present invention to provide sauna apparatus for high temperature sauna and low temperature sauna uses simply by adjusting the high temperature sauna apparatus to function at the lower temperatures without requiring special costly controls.

Another object of the present invention is to provide a sauna apparatus in which an adjustable ventilation opening in any wall of the sauna chamber is provided at a position substantially opposite to the head location of a person in a sauna chamber wherein when using the sauna apparatus for high temperature sauna, the ventilation opening is closed to close the sauna chamber and to enable setting the sauna chamber at high temperature to promote perspiration of the person in the sauna chamber. When the sauna apparatus is intended to be used as a low temperature sauna, namely at a warm bath equivalent temperature, the ventilation opening is opened to provide communication between the interior and the exterior of the sauna chamber to permit maintenance of a temperature that will not cause perspiration of the person in the chamber to provide the lower temperature warm bath effect, and also to provide comfortable conditions with a cool head and warm leg to permit to staying in the sauna for a long period to promote improved blood circulation.

To achieve the foregoing object, a sauna apparatus, according to the present invention, comprises a sauna chamber defined by left and right sidewalls, a front wall and a back wall and an upper cover or ceiling for the chamber of a size accommodating a person therein, and an adjustable ventilation opening at a position substantially opposite to the head of a person in the sauna chamber.

A suitable embodiment of the present invention, includes a lid that can be opened and closed over the ventilation opening by a detachable engaging mechanism. The detachable engaging mechanism can involve closure fabrics, magnets, or metal hooks engageably mounting the lid over the ventilation opening. Alternatively the detachable engaging mechanism can have an annular engaging groove formed on an inner peripheral surface of the ventilation opening, an engaging claw provided on a slider movable in diametrical direction of the lid member, a spring biasing the engaging claw to engage with the engaging groove, and a knob for operating the slider to release the claw from engagement with the engaging groove against the spring. In this latter alternative of the detachable engaging mechanism the lid is mounted on the wall by a hinge, and means are provided for opening and closing the lid over the ventilation opening.

BRIEF DESCRIPTION OF THE DRAWING

The present invention will be understood more fully from the detailed description given herebelow and from the accompanying drawing, wherein.

DETAILED DESCRIPTION

Figure 1:
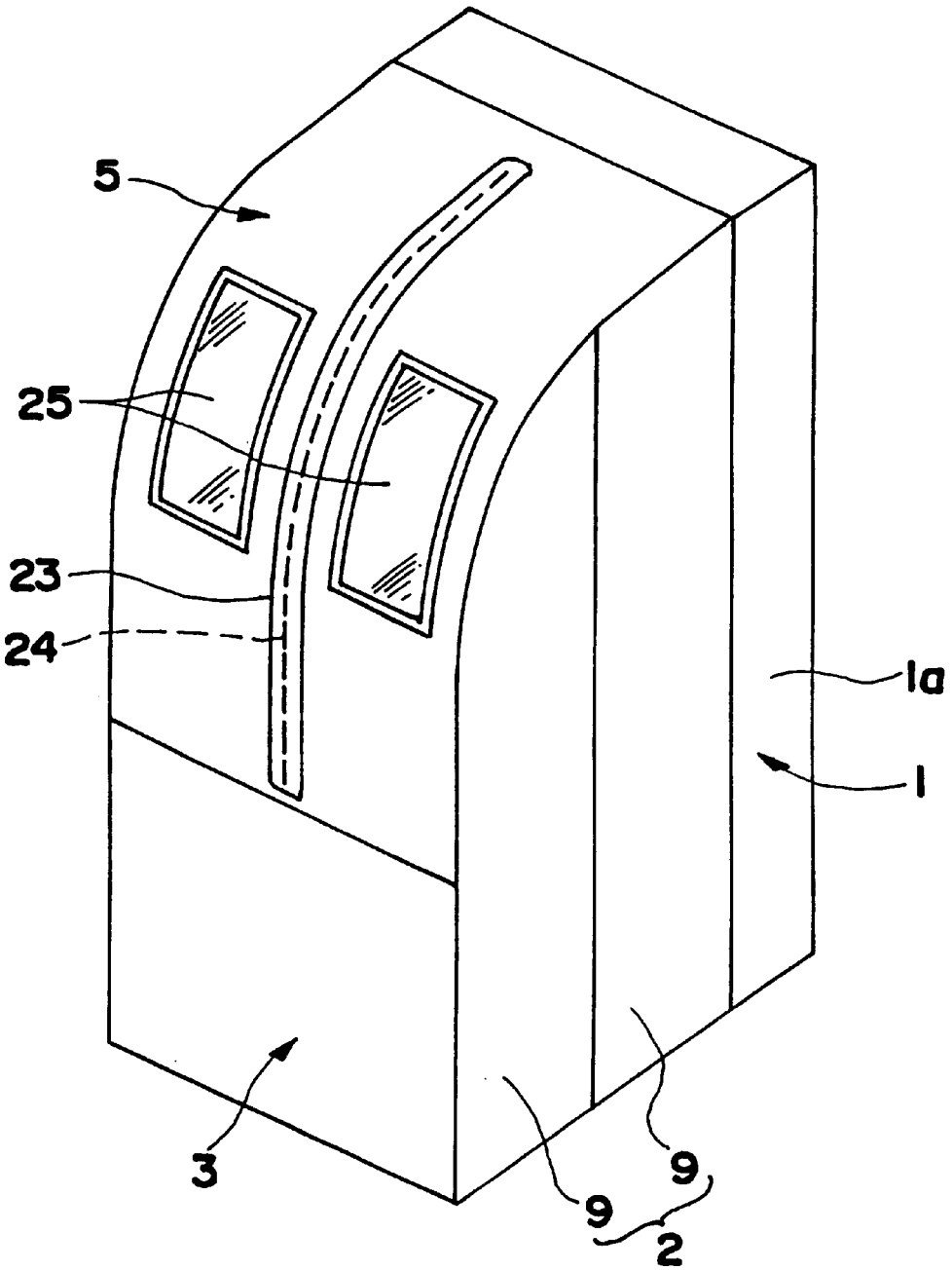
FIG. 1 is a perspective view showing an external appearance of an embodiment of a sauna apparatus according to the present invention.

In the embodiment of FIGS. 1–4 a gate shaped main body frame and sidewalls 2 extend from the front edges along both the left and right sides of the main body frame 1. A front wall 3 extends between the front ends of the side walls 2. A back wall 4 is arranged at the back of the main body frame 1. A top opening surrounded by both sidewalls 2 the front wall 3 and the main body frame 1, is covered with an upper cover or ceiling portion 5. Thus, a sauna chamber 6, is defined, wherein one person can be comfortably accommodated. A ventilation opening 7 is adjustably arranged in the upper side of the back wall member 4, at a location substantially corresponding to the location of the head of the person in the sauna chamber. Suitably the sidewalls 2 are constructed each from two pieces of divided sidewall segments 9 pivotally connected to each other for inwardly holding, as shown in FIG. 5.

Figure 2:
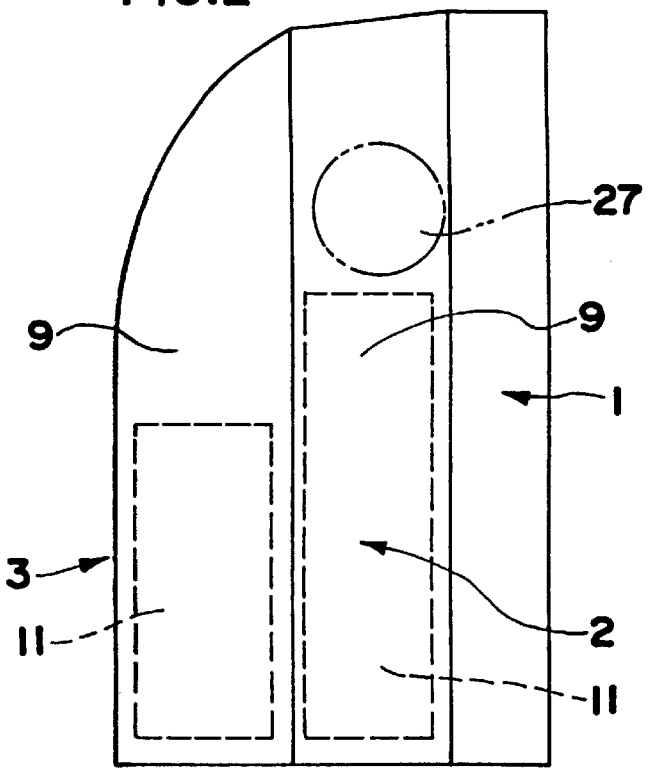
FIG. 2 is a side view of the embodiment of the sauna of FIG. 1.
Figure 3:
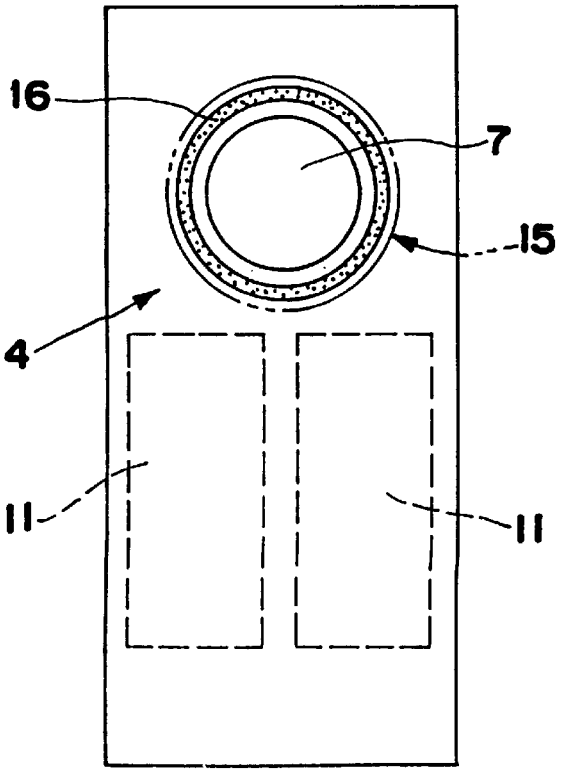
FIG. 3 is a rear elevation of the embodiment of the sauna apparatus of FIG. 1.
Figure 5:
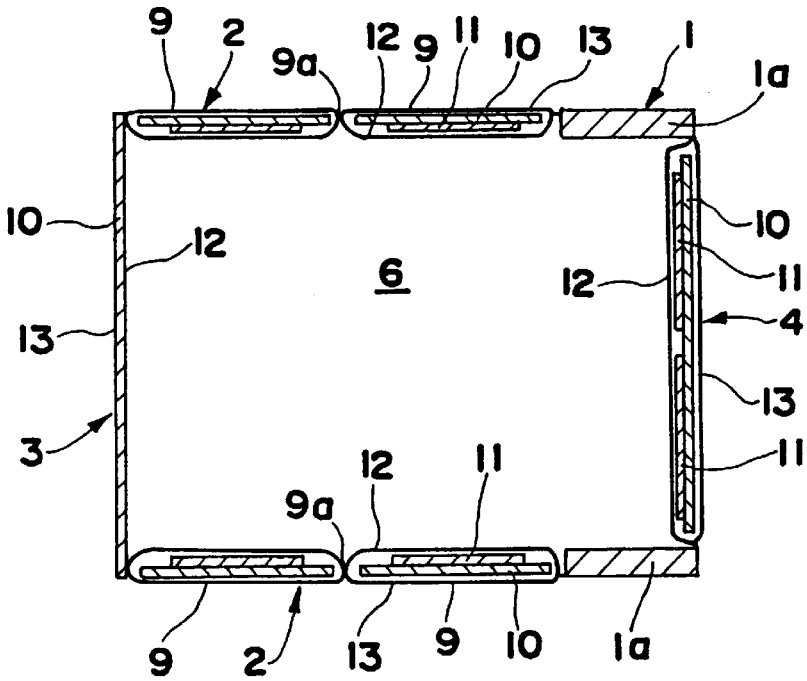
FIG. 5 is an enlarged portion of a cross-sectional view showing a detail of a wall portion of the sauna apparatus of FIG. 1.

Respective divided sidewall segments 9 of the sidewall 2 and the back wall 4 are formed with heat insulating panels 10 of respective corresponding sizes, flat electrical heating elements 11 are provided on the inner surface respective heat insulation panels 10, and inner upholstery wall covering 12 and outer upholstery covers drape respectively the inner and outer surfaces of each of the assemblies of the heat insulation panel and the flat electrical heating element 11, as shown in FIG. 5. In FIGS. 2 and 3, the arrangement of the flat electrical heating elements 11 is illustrated by broken line. The front wall 3 is formed by covering the inner and outer surfaces of the heat insulation panel 10, as shown in FIG. 5. The joints respectively of the main body frame 1, the sidewalls 2, the front wall 3 and the back wall 4, and of pivot portions 9*a* of the sidewalls 2 are permitted to pivot by joining the inner and outer upholstery cloth covers together, such as by sewing. Thus, from the condition where the sauna chamber 6 is set up as shown in FIG. 5, both sidewalls are inwardly folded to stack the front wall 3 onto the folded divided segments 9 of the sidewall 2 compactly to hold the front wall 3 and the sidewalls in front of the main body frame 1 for storage.

Figure 4:
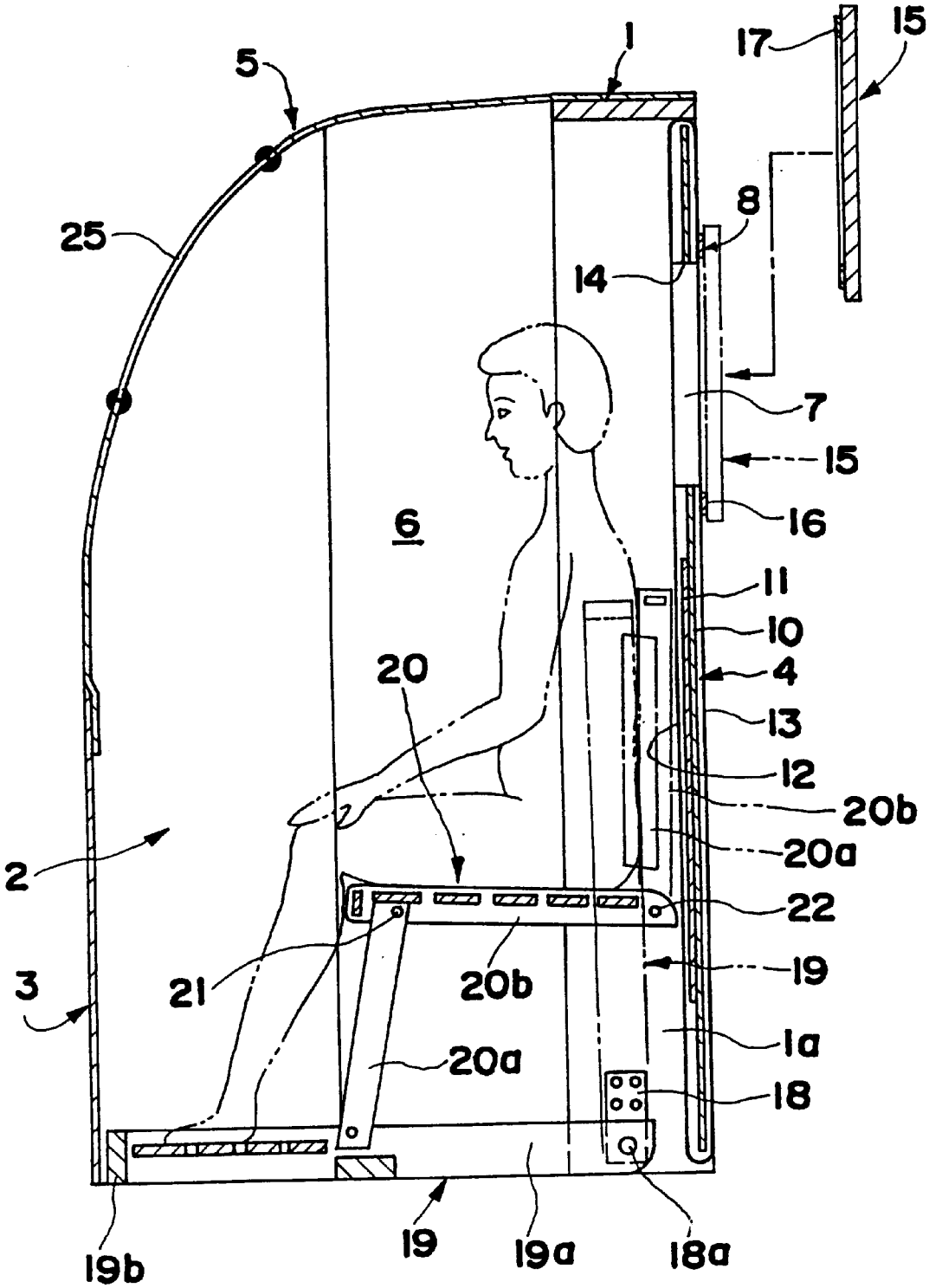
FIG. 4 is an enlarged longitudinal cross-sectional view of the sauna apparatus of FIG. 1.

As shown in FIGS. 3 and 4, the ventilation opening 7 is provided in the upper portion of the back wall 4 where no flat electrical heating element 11 is located. Therefore, the ventilation opening 7 can be formed by forming e.g. circular holes through the inner and outer upholstery fabric covers and the heat insulation panel 10, and fitting a marginal edging 14 into the hole. A circular plate forms an edging lid 15, in the ventilation opening 7, for example by being detachably mounted by a detachable engaging mechanism 8. For this purpose, a ring shaped engaging cloth 16 is rigidly attached onto the outer peripheral portion of the ventilation opening 7. On the inner surface of the lid member 15, a ring shaped engaging cloth 17 which is engageable with the engaging cloth 16, is rigidly attached about the opening to the exterior of the back wall 4. Magnets can be employed in place of the engaging cloth 16. In such case, the magnetic metal piece, such as a steel plate, or a permanent magnet is mounted on the periphery of the ventilation opening 7, and the magnet or the counter-metal piece is attached to the lid 15. It is also possible to provide a hooking eye on the lid 15 and to provide a metal hooking on the outer periphery of the ventilation opening 7 on the side of the wall 4 corresponding to the hooking eye. The lid 15 can be formed by covering the entire surface by the cloth. While the ventilation opening 7 is opened and closed from outside of the sauna chamber in the structure shown in FIG. 4, it is also possible to open and close the ventilation opening 7 from the interior of the sauna chamber 6.

As shown in FIG. 4, a metal pivot 18 is mounted on the lower end portion of the gate shaped main body frame 1. The end portions of the channel shaped frame 19 are pivoted by a pivot shaft 18*a* from the metal pivot 18. The channel shaped frame member 19 is vertically pivoted between (i) a horizontal position (shown by solid line) engaging on the inner periphery of the sidewalls 2 and the front wall 3, and (ii) a vertical position (shown by broken line) where the lower ends of the side walls 2 and the front wall 3 are folded onto the main body frame 1. A foldable seat 20 is mounted from the channel shaped member 19. The foldable seat 20 has legs 20*a*, the lower ends of which are pivoted from intermediate portions of both sides 19*a* of the channel shaped frame, and a seat frame 20*b*, the rear end of which is pivoted at 21 and from the side 1*a* of the main body frame 1, by pivot shafts 22, at an appropriate height. When the channel shaped frame 19 is raised, the foldable seat 20 can also be folded up at the same time as shown by broken line in FIG. 4, to be accommodated within the main body frame 1 together with the channel shaped frame 19.

The top cover 5 of the sauna chamber 6 is suitably of a flexible material. As shown in FIGS. 1 and 4, the periphery of the cover 5 is connected to the respective upper edges of both sidewalls, 2 and front wall 3, and with the upper edge portion of the main body frame 1. While not shown, the upper cover or ceiling 5 is formed by applying a heat reflective aluminum foil to the inner surface of a flexible thin heat insulating webbing and the heat insulating webbing with the aluminum foil is covered with the inner and outer upholstery clothes and then sewn together with the inner and outer covering cloths.

As best shown in FIGS. 1 and 4, an opening 23 is formed at the center portion of the ceiling cover 5 which can be opened and closed by appropriate means, such as a fastener or zipper. The opening 23 is to permit the use of entry into and exit from the sauna chamber 6. Windows 25 are suitably formed in the ceiling with transparent sheets or the like. While not shown, lighting equipment, such as a fluorescent lamp or the like can be provided at any suitable location or the upper portion of the sauna chamber 6.

The flat heating element 11 has a conventional, flat structure and is suitably adapted to radiate far infrared rays. For example, suitably a sheet in which a resistor film having a necessary electric resistance is formed on an electrically nonconductive base plate by applying a mixture of carbon powder and a binding material, such as polyethylene, lead wires are mounted over the entire length of the element, and a heat resisting waterproof layer of electrically nonconductive material is deposited on the surface of the base plate coated with the resistor film, can be employed. The temperature of the flat heating elements 11 can be controlled by any known temperature adjusting device.

In the sauna constructed as set forth above, using a high temperature sauna apparatus as originally intended for the sauna, the ventilation opening 7 in the back wall 4 can be closed by the lid 15 to enclose the sauna chamber 6. Then, the temperature of the flat heating elements is adjusted to a desired relatively high temperature. The interior of the sauna chamber 6 can be maintained in this manner at high temperatures to promote perspiration of the user.

When the sauna apparatus of the present invention is to be used as warm bath-like, or lower temperature device, the lid 15 is removed from the ventilation opening 7 to open it and to permit communication of air in and out of the sauna chamber 6. At the same time the heating temperature of the flat heating elements 11 is set at lower temperature than that in the case of the high temperature sauna, so that the temperature within the sauna chamber 6 is maintained lower than that is required to cause perspiration of the user, to subject the user instead to the so-called warm bath effect. In this case, since as shown in FIG. 4, the ventilation opening 7 is provided at a position substantially at the head of the user in the sauna chamber 6, the temperature in the vicinity of the user's head becomes lower to cool the head but permit a warm leg for the comfort of the user. Also, with such construction, the user may stay in the sauna chamber 6 for a relatively long period to achieve good blood circulation.

While the ventilation opening 7, in the illustrated embodiment of the present invention, is provided only in the back wall 4, it is also possible to provide a ventilation opening 27 in a sidewall 2, as shown in FIG. 2. Alternatively, it is also possible to provide the ventilation opening in the front wall 3, or in the upper ceiling cover 5. The ventilation opening can thus also be provided any back wall 4, the sidewall 2 and the ceiling cover 5. It is further possible to open and close the windows 25 in the ceiling cover 5. For use as the warm bath, lower temperature equipment, the windows 25 can also be opened in conjunction with opening of the ventilation opening 7. It is also possible to provide a plurality of ventilation openings for convenient adjusting of the lower temperature for the warm bathing effect.

Figure 6:
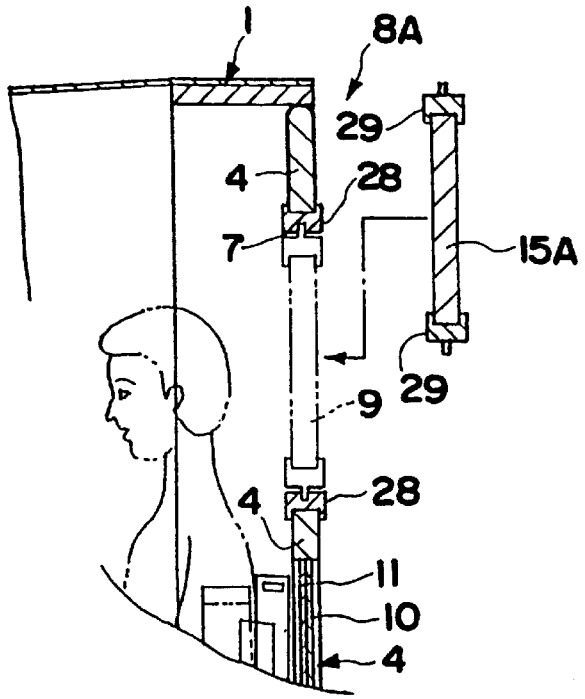
FIG. 6 is an enlarged portion of a longitudinal section of another embodiment of the present invention.
Figure 7:
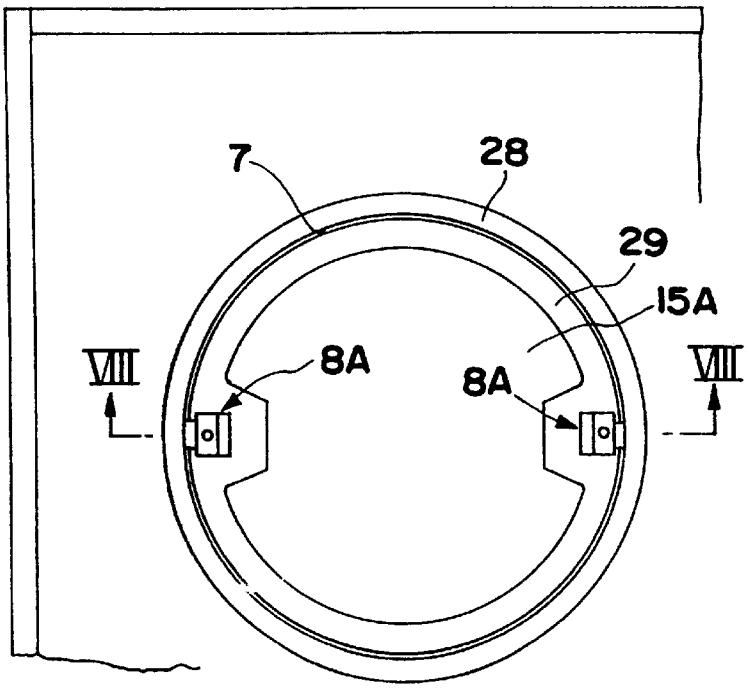
FIG. 7 is a rear elevation of another embodiment of the sauna of FIG. 6.
Figure 8:
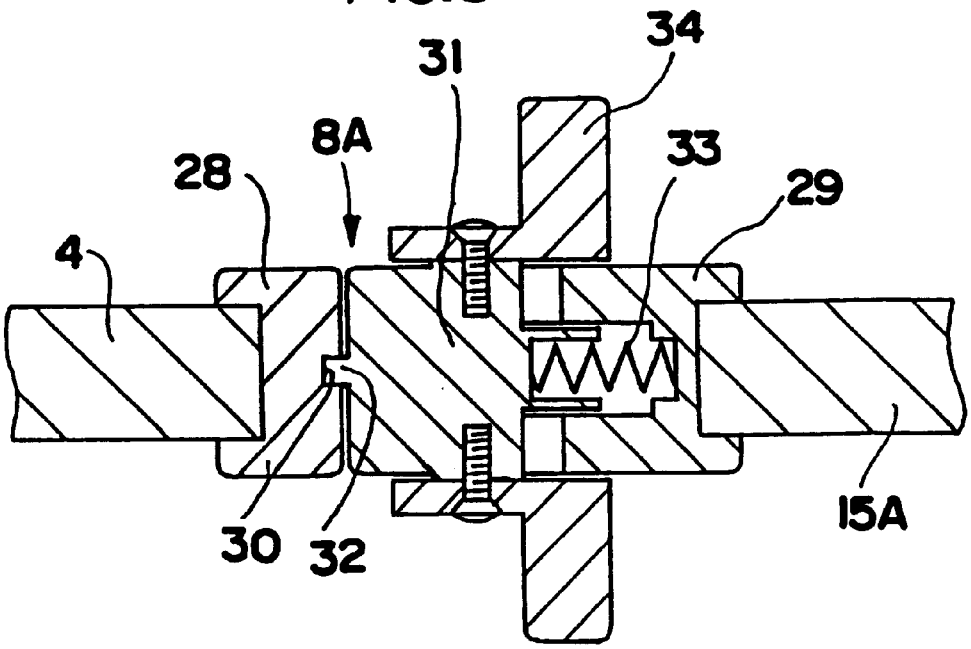
FIG. 8 is a cross-sectional view taken along the line A—A of FIG. 7.

FIGS. 6 to 8 show another embodiment of a detachable engaging mechanism 8A of the present invention. On one side of the back wall on an outer periphery 4, a lid 15A is provided having an inner peripheral frame 29 engaging with the outer peripheral edge 28. The lid is detachably mounted in the ventilation opening 7.

FIG. 8 shows a section taken along line A—A of FIG. 7, of the detachable engaging mechanism embodiment 8A. An annular engaging groove 30 is formed on the inner peripheral surface of the outer peripheral edge 28 on the side of the back wall 4. Movable sliders 31, movable in the diametrical direction, are provided at diametrically symmetric positions of the inner peripheral frame 29 on the side of the lid 15A. An engaging claw 32 is projected on the tip end of a slider 31 engageable with the engaging groove 30 on the side of the outer peripheral edge 28. The engaging claw 32 is biased toward the annular engaging groove 30 by a spring 33 disposed between the slider 31 and the inner peripheral frame 29. An actuation knob 34 is attached to the slider 31 by a screw, for retracting the slider 31 against the bias of the spring 33.

By the detachable engaging mechanism 8A constructed as set forth above, the engaging claw 32 at the tip end of the slider of the inner peripheral frame 29 on the side of the lid 15A, is biased for engagement with the engaging groove 30 of the outer peripheral edge 28 of the back wall 4 by the spring 33. This closes the lid 15A over the ventilation opening 7 to enclose the sauna chamber 6. Then, heating temperature of the flat heating element 11 is set at the predetermined high temperature by the high temperature control device for setting a high temperature in the sauna chamber 6 to provide perspiration by the user.

The detachable engaging mechanism 84 has an annular engaging groove 30 of the outer peripheral edge 28 of the rear wall 4, over the entire inner peripheral frame 29. An engaging claw 32 of a slider 31 can be engaged at any position of the inner peripheral frame of the outer peripheral edge 28 to facilitate the engaging operation. Since the engaging claw 32 assuredly attaches the lid 15A to the back wall 4 by being biased by the spring 33, the ventilation opening 7 cannot be unintentionally opened by the dropping of the lid 15A from the back wall 4 even due to impact, vibration or collision of the user's body with the lid 15A.

When this sauna construction is used at low temperatures, i.e. as warm bath equipment, the engaging claw 32 at the tip end of the slider 31 can also be released from engagement with the engaging groove 30 of the outer peripheral frame 29 on the side of the rear wall 4. The ventilation opening 7 can be closed by gripping the actuation knob 34 and by retracting the slider 31 on the side of the lid 15A, against the bias of the spring. The lid 15A can be moved from the ventilation opening 7 for opening it. Thus, communication of air in and out of the sauna chamber 6 is established and the heating temperature of the flat heating elements 11 is set at a low temperature so that no perspiration of the user will occur. By this measure the user can enjoy the lower temper warm bath effect.

It should be noted that while the detachable engaging mechanism 8A is provided on the exterior of the sauna chamber 6 as shown and described hereinabove, it is possible to provide the detachable engaging mechanism on the interior of the sauna chamber to permit actuation of the slider 31 from the inside of the sauna chamber 6 to attach or to detach the lid 15 to the ventilation opening 7.

Figure 9:
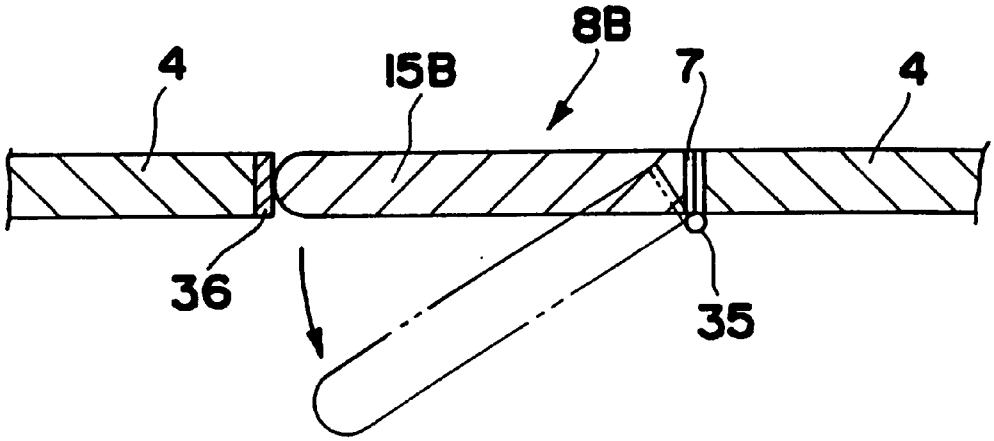
FIG. 9 is a longitudinal cross-sectional view showing the major part of a further embodiment of the sauna according to the present invention.

FIG. 9 shows a further embodiment of a detachable engaging mechanism 8B according to the present invention. This embodiment opens and closes a lid 15B by pivotally mounting the lid by a hinge 35. Upon closing, the lid 15B it electrically contacts the peripheral edge of the ventilation opening 7 by an elastic contact seal 36 to open the lid 15B as shown by arrow, depending upon the temperature of the sauna chamber 6. Thus an additional capability of adjustment of the opening of the ventilation opening 7 is accomplished by the detachable engaging mechanism 8B on the use temperature of the sauna chamber 6.

I claim:

1. A sauna which comprises:

(i) a sauna chamber of a size to accommodate a person therein, and two side walls, a front wall, a rear wall, and a ceiling, (ii) a ventilation opening in a wall of said sauna chamber, said opening being at a height corresponding to the location of the head of a person within the chamber and having a size sufficient to provide a low temperature sauna due to the communication of air between the interior and the exterior of the sauna chamber, (iii) a lid for selectively opening and closing said ventilation opening, and (iv) a detachable engaging mechanism for maintaining said lid in a preselected position relative to said opening, wherein said ventilation opening is substantially circular and has a diameter and an inner peripheral surface on the wall, and said detachable engaging mechanism comprises an annular engaging groove formed on said inner peripheral surface, a slider, an engaging claw on said slider, said slider being diametrically movable on said lid, a spring biasing said engaging claw into engagement with said engaging groove, and a knob for manually operating said slider for releasing said engagement against the bias of said spring.

* * * * *